US012082698B2

(12) United States Patent
Liu et al.

(10) Patent No.: US 12,082,698 B2
(45) Date of Patent: Sep. 10, 2024

(54) MECHANISM FOR ZERO-GRAVITY RECLINING CHAIR

(71) Applicant: HHC CHANGZHOU CORPORATION, Changzhou (CN)

(72) Inventors: Chih Hsiung Liu, Benoni (ZA); Zhi Liang Gao, Xiaji Town (CN)

(73) Assignee: MOTOMOTION CHINA CORPORATION, Changzhou (CN)

( * ) Notice: Subject to any disclaimer, the term of this patent is extended or adjusted under 35 U.S.C. 154(b) by 153 days.

(21) Appl. No.: 17/952,180

(22) Filed: Sep. 23, 2022

(65) Prior Publication Data

US 2024/0032693 A1 Feb. 1, 2024

(30) Foreign Application Priority Data

Jul. 29, 2022 (CN) ..... 202210906567.X
Jul. 29, 2022 (CN) ..... 202222002333.0

(51) Int. Cl.

| | |
|---|---|
| ***A47C 1/0355*** | (2013.01) |
| ***A47C 1/024*** | (2006.01) |
| ***A47C 1/032*** | (2006.01) |
| ***A47C 1/034*** | (2006.01) |
| ***A61G 5/14*** | (2006.01) |

(52) U.S. Cl.

CPC ..... *A47C 1/0242* (2013.01); *A47C 1/0345* (2013.01); *A47C 1/0355* (2013.01)

(58) Field of Classification Search

CPC . A47C 1/0355; A47C 1/03211; A47C 1/0345; A47C 1/035; A47C 7/5068; A47C 1/034

See application file for complete search history.

(56) References Cited

U.S. PATENT DOCUMENTS

| | | | | |
|---|---|---|---|---|
| 5,121,967 | A * | 6/1992 | Rogers | A47C 3/027 297/269.1 |
| 8,915,544 | B2 * | 12/2014 | LaPointe | A61G 5/14 297/DIG. 10 |
| 8,944,498 | B2 * | 2/2015 | Lawson | A61G 5/14 297/DIG. 10 |
| 9,468,295 | B2 * | 10/2016 | Lawson | A47C 1/0355 |
| 10,842,274 | B1 * | 11/2020 | Crawford | A47C 1/03211 |
| 11,452,378 | B1 * | 9/2022 | Li | A47C 1/0345 |
| 11,617,446 | B2 * | 4/2023 | Zhang | A47C 7/5068 297/423.26 |

(Continued)

*Primary Examiner* — Shin H Kim

(74) *Attorney, Agent, or Firm* — Law Office of Steven W. Weinrieb

(57) ABSTRACT

A mechanism for a zero-gravity reclining chair enables the zero-gravity reclining chair to achieve different positions, states, or modes, including a seated position, state, or mode, a standing position, state, or mode, a TV position, state, or mode, and a reclining position, state, or mode. The mechanism includes left and right-side linkage systems, as well as first and second linear actuators for moving the linkage system and chair components between the different positions, states, or modes. When the zero-gravity reclining chair is disposed at its reclining position, state, or mode, the backrest portion of the zero-gravity reclining chair is disposed at an elevational level which is the same as, or slightly below, that of the footrest portion of the chair so as to provide the occupant of the zero-gravity reclining chair with enhanced health effects.

17 Claims, 14 Drawing Sheets

(56) References Cited

U.S. PATENT DOCUMENTS 11,700,942 B2 * 7/2023 Li ..... A47C 17/04 297/85 R
11,744,368 B2 * 9/2023 Li ..... A47C 1/0355 297/84
11,766,124 B2 * 9/2023 Crawford ..... A47C 1/0355 297/85 R
11,944,199 B2 * 4/2024 Li ..... A47C 1/0345
2003/0015893 A1 * 1/2003 Hoffman ..... G06F 17/142 297/85 R
2010/0127555 A1 * 5/2010 Hoffman ..... A47C 3/0255 297/344.21
2011/0181094 A1 * 7/2011 Lawson ..... A47C 1/035 297/85 R
2012/0049606 A1 * 3/2012 Lawson ..... A47C 1/0355 74/521
2012/0299363 A1 * 11/2012 Crum ..... A47C 1/0352 297/85 M
2013/0175847 A1 * 7/2013 Lawson ..... A61G 5/14 297/85 M
2015/0054315 A1 * 2/2015 Donovan ..... A47C 1/0345 297/325
2015/0272335 A1 * 10/2015 Lawson ..... A47C 7/506 297/423.19
2015/0282619 A1 * 10/2015 Lawson ..... A47C 1/0355 297/83
2015/0289655 A1 * 10/2015 Lawson ..... A47C 1/0342 297/75
2018/0027965 A1 * 2/2018 Lawson ..... A47C 1/0345
2018/0027968 A1 * 2/2018 Lawson ..... A47C 1/0355
2018/0360217 A1 * 12/2018 Fei ..... A61G 5/14
2019/0290004 A1 * 9/2019 Lawson ..... A47C 1/0355
2020/0367652 A1 * 11/2020 Crawford ..... A47C 1/0355
2021/0219725 A1 * 7/2021 Sun ..... A47C 1/03211
2021/0361070 A1 * 11/2021 Zhang ..... A47C 1/0355
2022/0039558 A1 * 2/2022 Zhang ..... A47C 7/5068
2022/0346552 A1 * 11/2022 Crawford ..... A47C 1/0355
2022/0361674 A1 * 11/2022 Li ..... A47C 1/0355
2022/0400863 A1 * 12/2022 Murphy ..... A47C 3/0255
2024/0032693 A1 * 2/2024 Liu ..... A47C 1/0355
2024/0122345 A1 * 4/2024 Lake ..... A47C 3/20

* cited by examiner

MECHANISM FOR ZERO-GRAVITY RECLINING CHAIR

FIELD OF THE INVENTION

The present invention relates generally to furniture, more particularly to reclining chairs, and even more particularly to a new and improved zero-gravity reclining chair as well as a mechanism for achieving various positions for the chair, including a zero-gravity inclined position.

BACKGROUND OF THE INVENTION

Reclining chairs are of course well known and are in common use. They have become so ubiquitous that people often furnish their living rooms, family rooms, business offices, dens, basements, and home offices with such chairs. As is also well known, reclining chairs are able to attain various different positions, such as, for example, a conventional seated position, a reclined position, and a TV position. Since there are so many different reclining chairs to select from, as manufactured by many different companies, one of the factors that probably determines which particular reclining chair a person will select for their personal use either within their home or office, will be the degree of comfort, provided by the reclining chair to the person, when the person is actually seated within, or lying upon, the particular reclining chair. In addition, in current times, people are also becoming ever more increasingly health-conscious. Accordingly, people want to ensure, as best as possible, that when they are disposed within their favorite reclining chair, that they are not only comfortable, but also effectively practicing or achieving safe or enhanced health habits, particularly when they are disposed within the reclined position.

A need therefore exists in the art for a new and improved reclining chair. Another need exists in the art for a new and improved reclining chair which will provide the user with enhanced comfort. Still another need exists in the art for a new and improved reclining chair which will provide the user with enhanced comfort regardless of the particular position or mode the reclining chair is in, that is, the seated position, the reclined position, or the TV position. Yet another need exists in the art for a new and improved reclining chair which will provide the user with enhanced comfort regardless of the particular position or mode the reclining chair is in, that is, the seated position, the reclined position, or the TV position, and furthermore, when the reclining chair is disposed in or at the inclined position, enhanced health benefits can be derived and provided to the person while the person is disposed in or at the inclined position.

OVERALL OBJECTIVES OF THE PRESENT INVENTION

An overall objective of the present invention is to provide a new and improved reclining chair. Another overall objective of the present invention is to provide a new and improved reclining chair which will provide the user with enhanced comfort. Still another overall objective of the present invention is to provide a new and improved reclining chair which will provide the user with enhanced comfort regardless of the particular position or mode the reclining chair is in, that is, the seated position, the reclined position, or the TV position. Yet another overall objective of the present invention is to provide a new and improved reclining chair which will provide the user with enhanced comfort regardless of the particular position or mode the reclining chair is in, that is, the seated position, the reclined position, or the TV position, and furthermore, when the reclining chair is disposed in or at the inclined position, enhanced health benefits can be derived and provided to the person while the person is disposed in or at the inclined position.

SUMMARY OF THE INVENTION

The foregoing and other objectives are achieved by providing a new and improved zero-gravity reclining chair which comprises a mechanism that can effectively provide the new and improved reclining chair with a zero-gravity reclined position whereby enhanced health benefits, such as, for example, reducing the burden upon the person's heart to pump blood throughout the body, and thereby promote good blood circulation, can be achieved. More particularly, the new and improved zero-gravity reclining chair is seen to comprise a chair base, a chair frame, and a pair of linkage systems or mechanisms movably mounted upon opposite sides of the chair base and operatively connected to the chair base, the chair frame, and the seat, backrest, and footrest sections so as to be capable of moving the reclining chair between various different positions, such as, for example, a seated position, a standing position, a TV position, and a reclined position. When the reclining chair is moved to the reclined position, the reclining chair will attain a disposition wherein the backrest section is effectively disposed at a position or elevation which is effectively slightly lower than that characteristic of a backrest section of a conventional reclining chair while, at the same time, the footrest section of the reclining chair is effectively disposed at a position or elevation which is effectively slightly higher than that characteristic of a footrest section of a conventional reclining chair. Furthermore, and more particularly, when the reclining chair is disposed at its reclined position, the body of the person, disposed within the reclining chair, is effectively disposed at such a disposition or orientation that the footrest is disposed at an elevation that is the same as or slightly higher than that of the seat and backrest, so as to effectively define a zero-gravity position at which the comfortability of the person is enhanced while the burden upon the person's heart, in order to pump blood throughout the person's body, is effectively reduced. A pair of linear actuators are operatively connected between the chair base, the chair frame, and the linkage systems or mechanisms so as to achieve the various movements of the seat, backrest, and footrest sections between the various extended, retracted, or tilted dispositions characteristic of the aforenoted seated, standing, TV, and reclined positions.

BRIEF DESCRIPTIONS OF THE DRAWINGS

Various other features and attendant advantages of the present invention will be more fully appreciated from the following detailed description when considered in connection with the accompanying drawings in which like reference characters designate like or corresponding parts throughout the several views, and wherein:

FIG. 1 is rear, right side, perspective view of a zero-gravity reclining chair, as constructed in accordance with the principles and teachings of the present invention, showing the chair base and chair framework, the seat mounting brackets, the backrest mounting brackets, the footrest mounting brackets, the linkage systems or mechanisms operatively interconnecting all of the aforenoted components together, and the pair of linear actuators operatively connected to particular ones of the aforenoted components so as to move the various components of the reclining chair between seated, standing, TV, and reclined positions, the reclining chair being illustrated at its reclined position;

Figure 6:
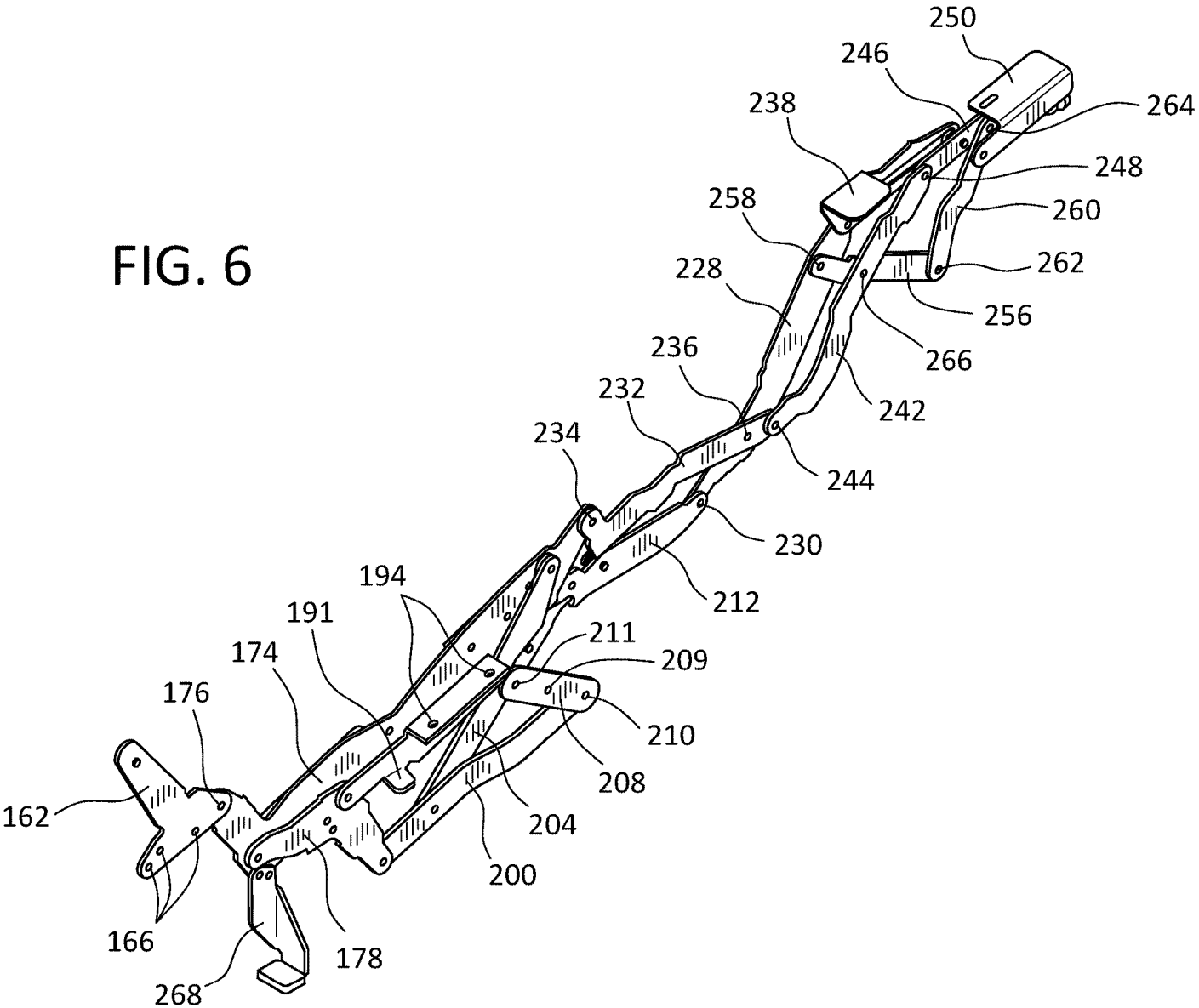
Figure 7:
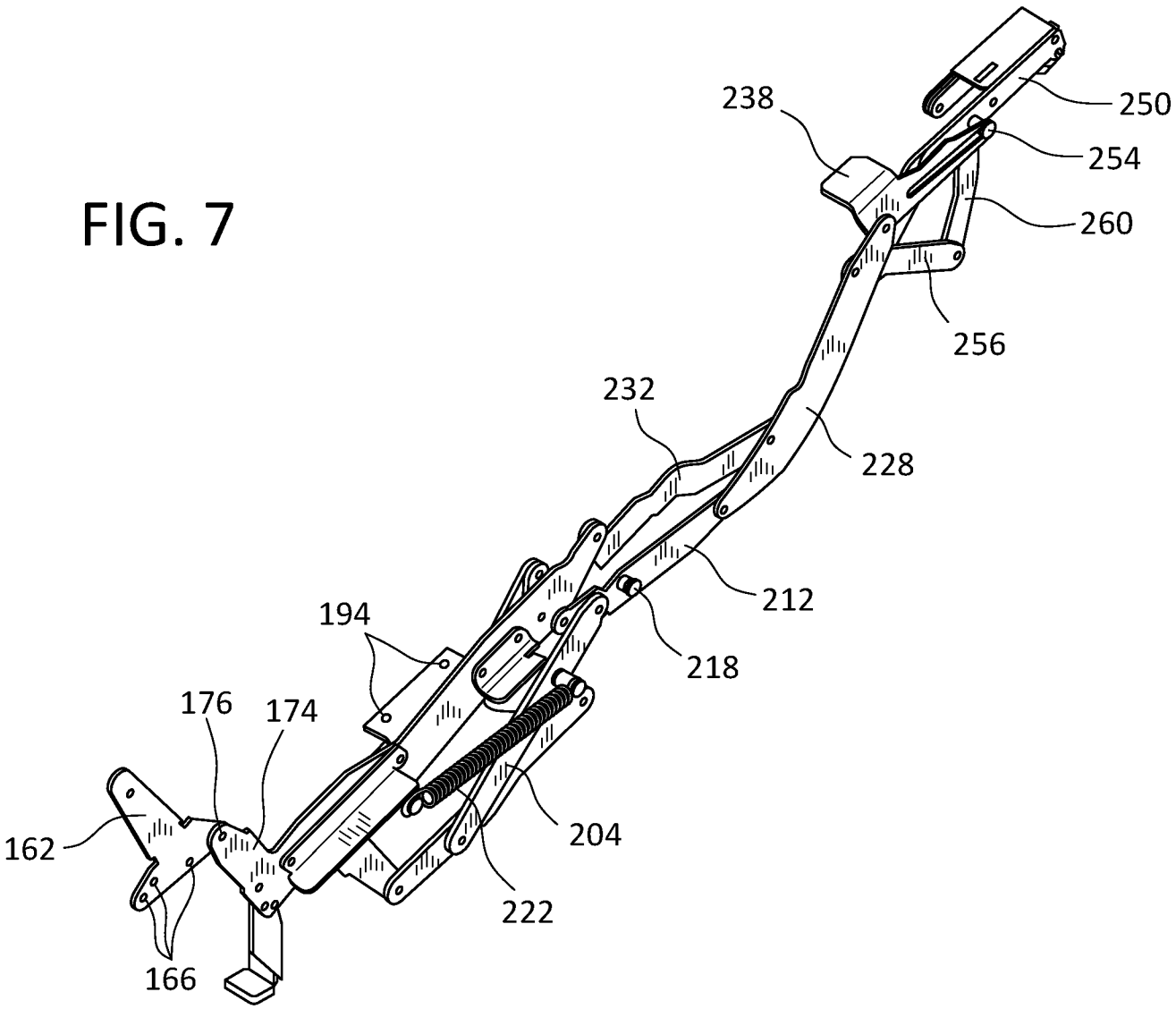
Figure 8:
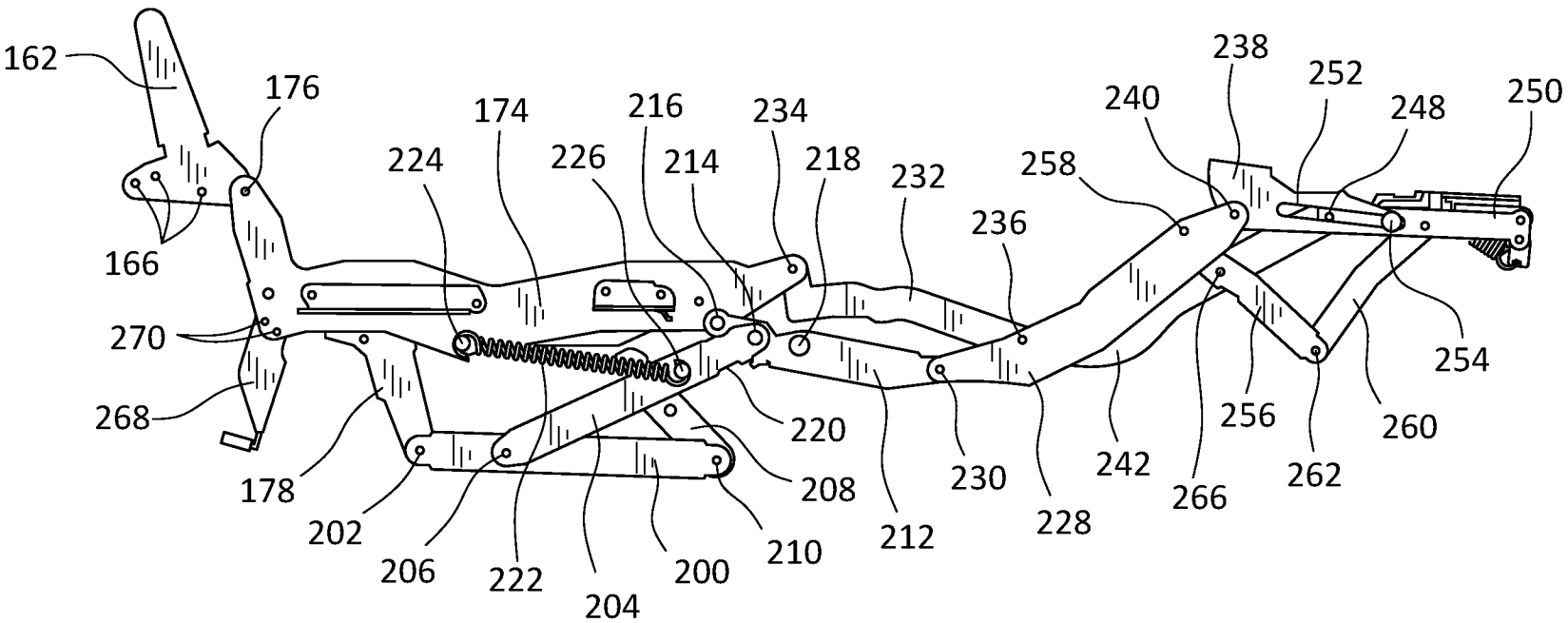
Figure 9:
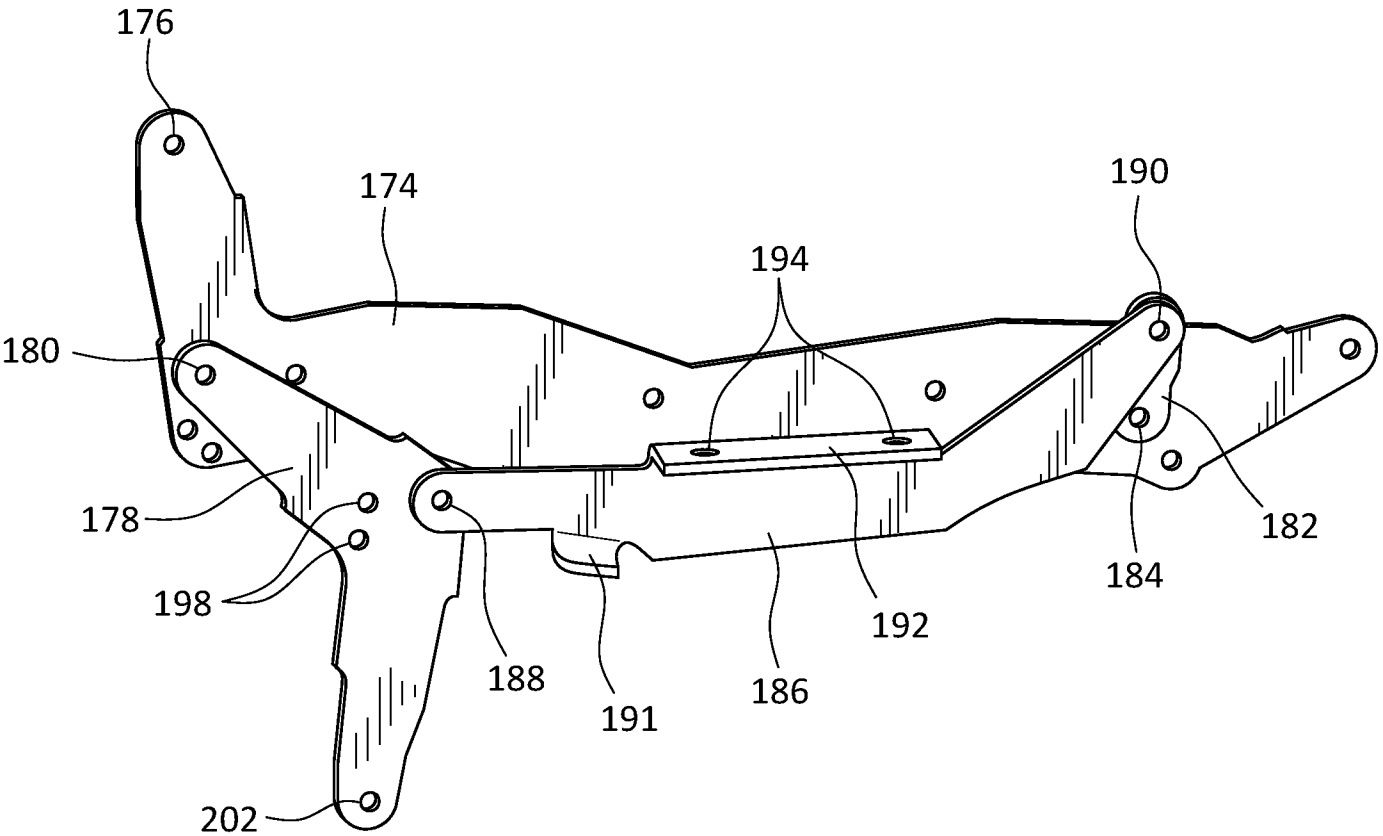
Figure 10:
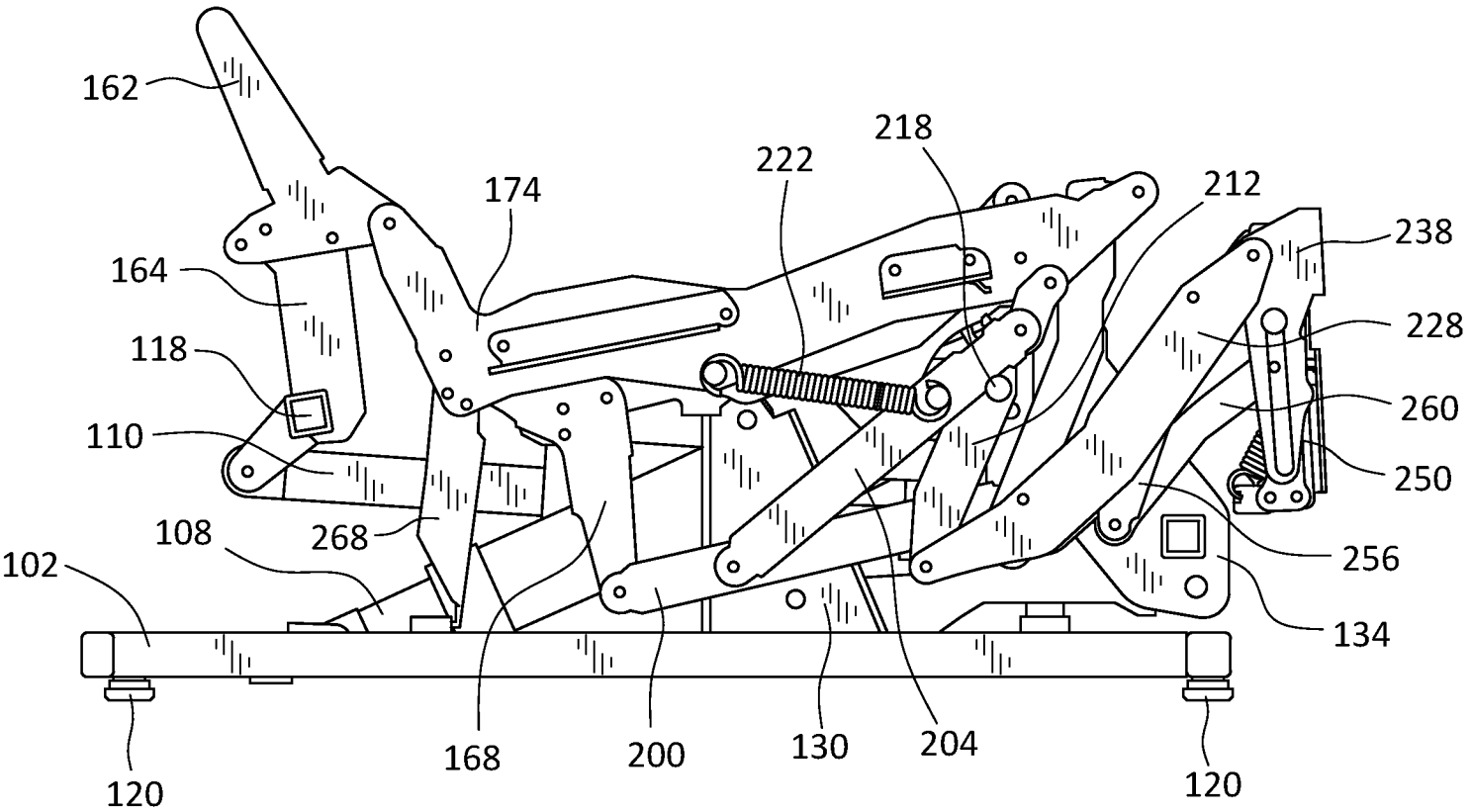
Figure 11:
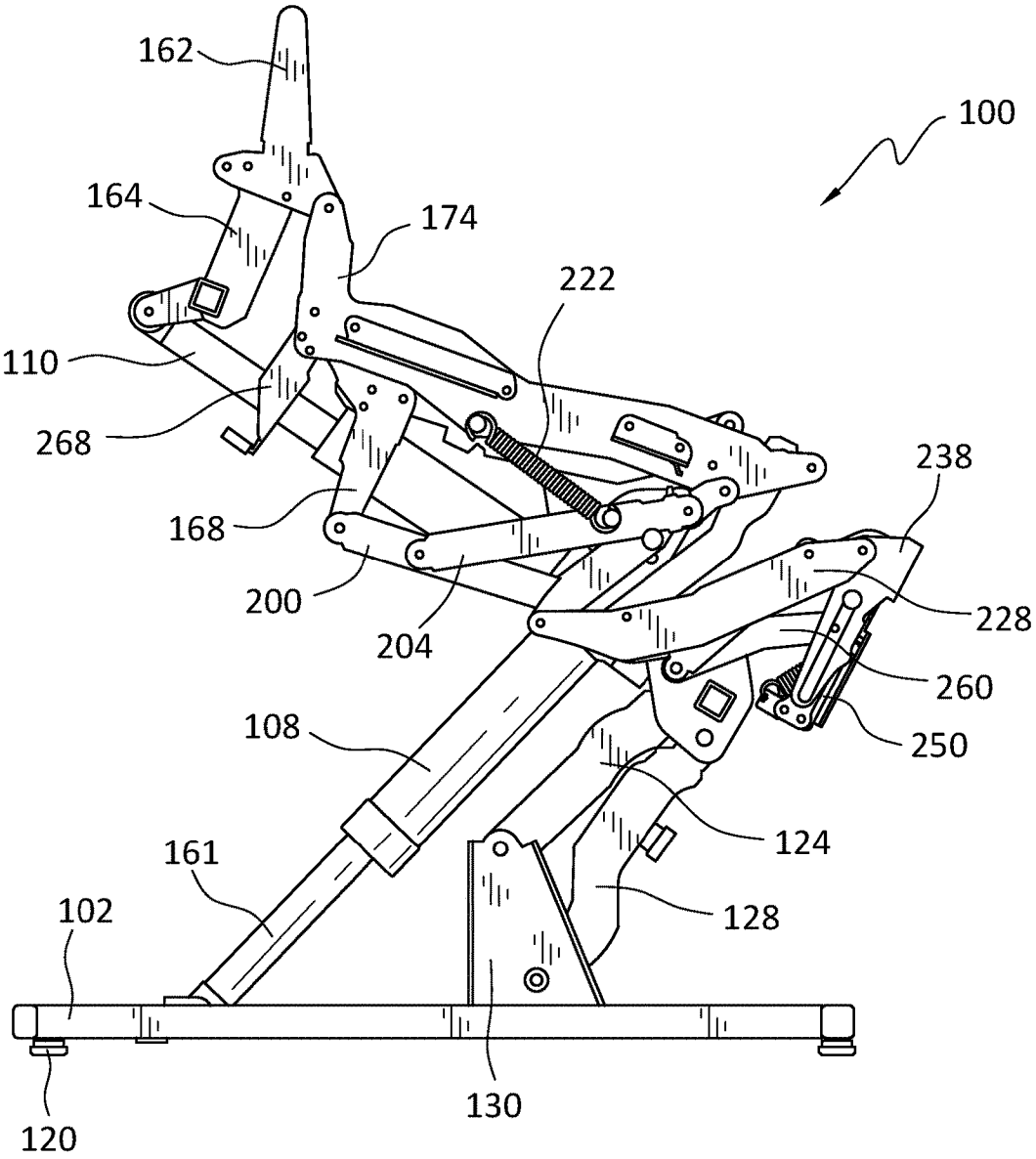
Figure 12:
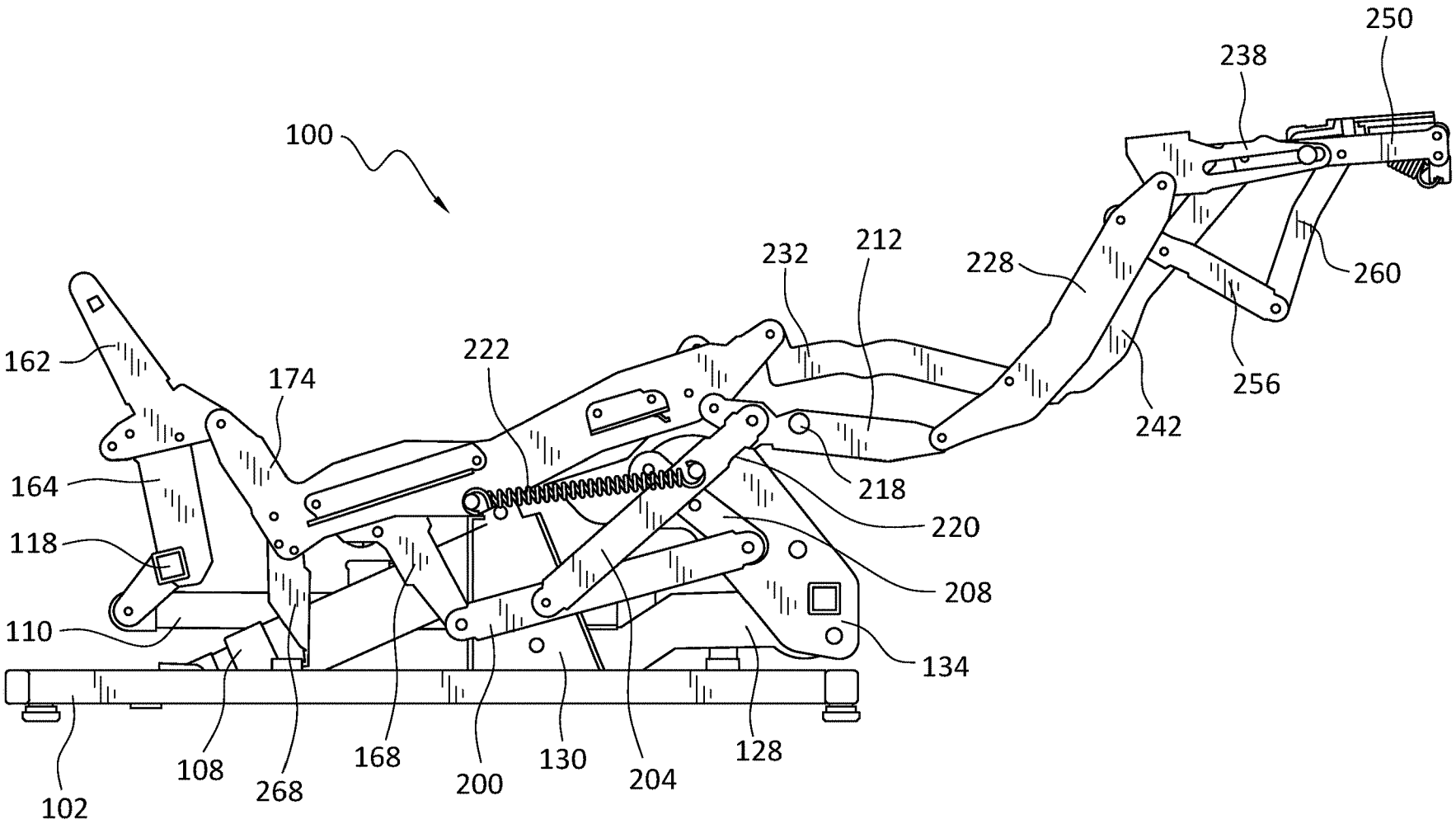
Figure 13:
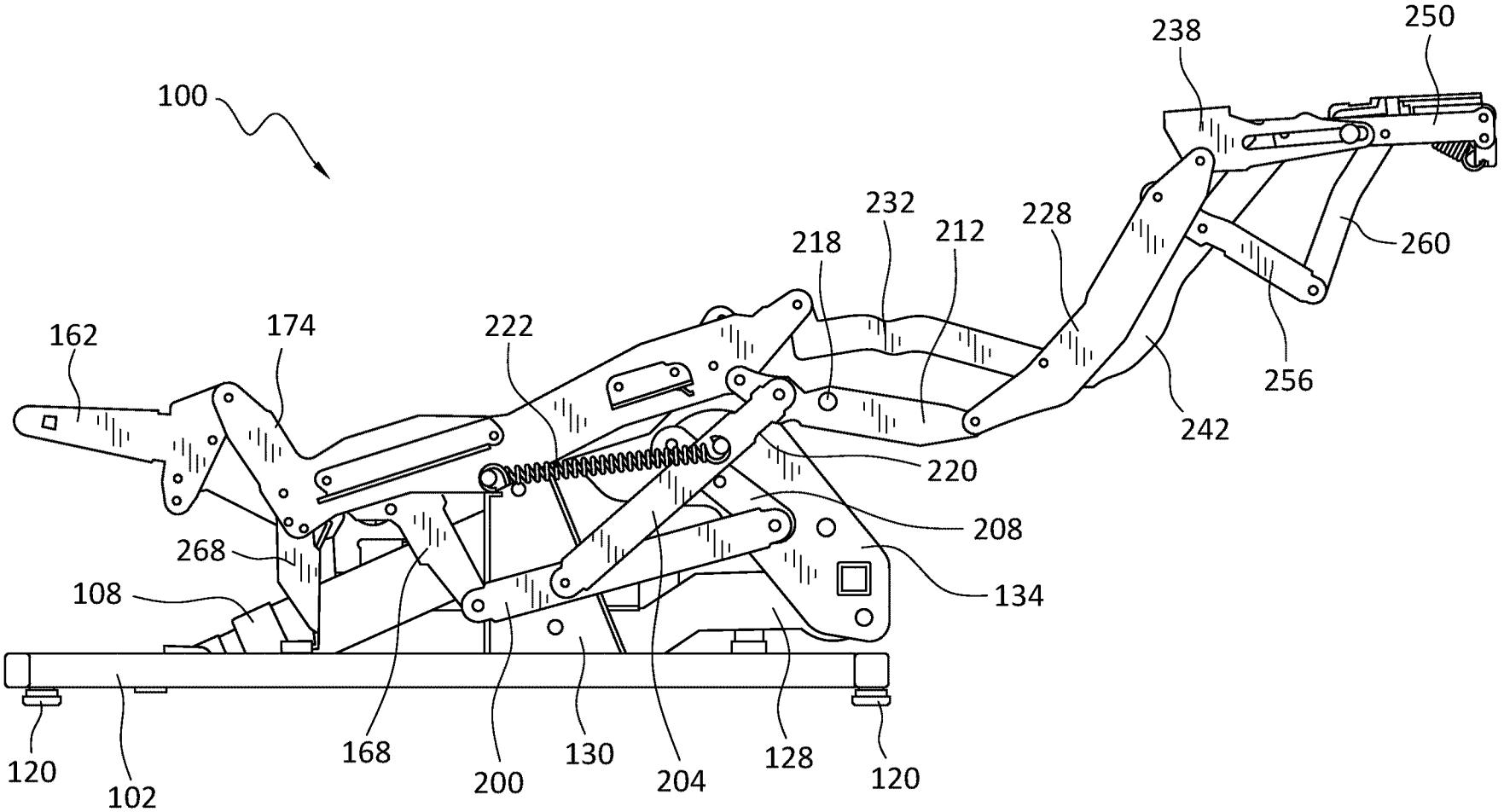
Figure 14:
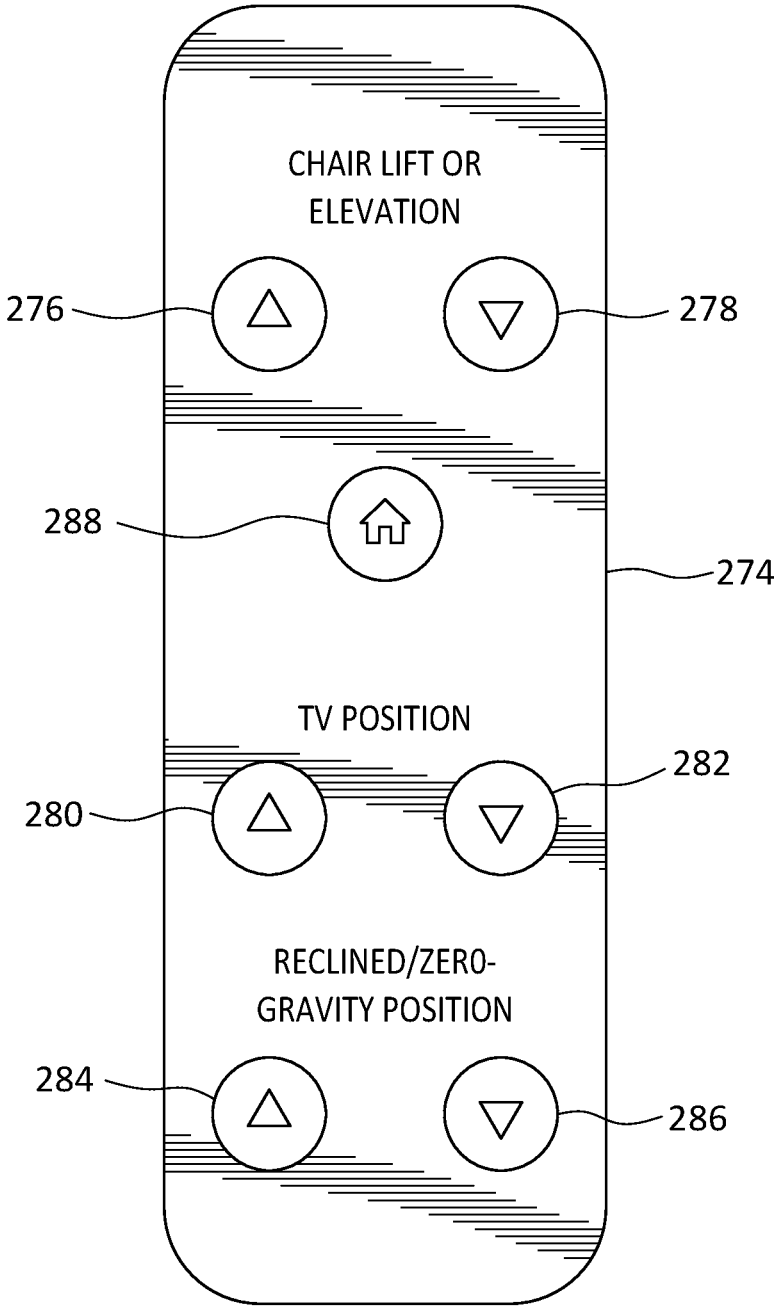

FIG. 6 is a schematic perspective view showing the plurality of linkage members comprising the left side linkage system or mechanism as operatively connected to the left side backrest mounting bracket, the left side seat mounting bracket, and the left side footrest mounting bracket, and as viewed from a viewpoint internally within the mechanism comprising the zero-gravity reclining chair whereby the zero-gravity reclining chair is disposed at its TV position;

FIG. 7 is a schematic perspective view showing the plurality of linkage members comprising the right-side linkage system or mechanism as operatively connected to the right-side backrest mounting bracket, the right side seat mounting bracket, and the right side footrest mounting bracket, and as viewed from a viewpoint externally of the mechanism comprising the zero-gravity reclining chair whereby the zero-gravity reclining chair is disposed at its TV position;

FIG. 8 is a side elevational view of the right-side linkage system or mechanism as shown in FIG. 7 when the right-side linkage system or mechanism has been extended so as to place the zero-gravity reclining chair in its TV position;

FIG. 9 is a side elevational view of the left side reclining link assembly;

FIG. 10 is a right-side elevational view of the reclining chair of the present invention when the reclining chair is disposed at its seated position;

FIG. 11 is a right-side elevational view of the reclining chair of the present invention when the reclining chair is disposed at its standing position;

FIG. 12 a right-side elevational view of the reclining chair of the present invention when the reclining chair is disposed at its TV position;

FIG. 13 a right-side elevational view of the reclining chair of the present invention when the reclining chair is disposed at its reclined position at which the zero-gravity position or state is defined; and FIG. 14 is a schematic view of a remote-control device that may be utilized to control the movements of the first and second linear actuators.

DETAILED DESCRIPTION OF THE PREFERRED EMBODIMENT

With reference firstly being made to FIGS. 1-5, a new and improved mechanism for a zero-gravity reclining chair, as constructed in accordance with the principles and teachings of the present invention, is disclosed and is generally indicated by the reference character 100. More particularly, it is additionally seen, generally speaking, that the new and improved mechanism 100 for the zero-gravity reclining chair comprises a chair base 102, a chair framework 104 operatively mounted upon, or connected to, the chair base 102, left and right side linkage systems 106,106 operatively connected to the chair framework 104, and first and second linear actuators 108,110 operatively connected to the chair base 102 and the chair framework 104, or between different components of the chair framework 104. The chair base 102 has a substantially rectangular configuration that comprises left and right side, longitudinally extending base members 112,114, a first, transversely oriented base member 116 connecting the front ends of the left and right-side base members 112,114 together, and a second, transversely oriented base member 118 connecting rear end portions of the left and right-side base members 112,114 together. In addition, the rear terminal end portions of the left and right side, longitudinally extending base members 112,114, and the oppositely disposed left and right terminal ends of the first, transversely oriented base member 116, are provided with adjustable leveling bolts 120. Continuing further, it is seen that the chair framework 104 comprises a pair of oppositely disposed, upstanding chair framework mounting brackets 122,122 which are fixedly secured to the oppositely disposed left and right side, longitudinally extending base members 112,114, as can best be seen, for example, in FIGS. 4 and 5. Each one of the mounting brackets 122,122 has a substantially trapezoidal configuration, and it is further seen that each one of a pair of laterally or transversely spaced first lift links 124,124 is pivotally connected at a first end thereof to an upper end portion of each one of the mounting brackets 122,122 by pivotal connections 126,126, while each one of a pair of laterally or transversely spaced second lift links 128,128 is pivotally connected at a first end thereof to a lower end portion of each one of the mounting brackets 122,122 by pivotal connections 130,130, all as can best be seen in FIGS. 4 and 5. In addition, as can also be best appreciated from FIG. 5, lower end portions of the pair of laterally or transversely spaced second lift links 128,128 are connected to each other by a first transversely oriented cross-tube 132 so as to effectively provide the second lift links 128,128 with enhanced stability and rigidity.

Still yet further, it is seen that the opposite ends of the first and second lift links 124,124,128,128 are pivotally connected to a pair of oppositely disposed, transversely spaced seat base brackets 134,134 by pivotal connections 136,136, 138,138, and it is also seen that the lower end portions of the seat base brackets 134,134 are connected together by a second transversely oriented cross-tube 140 so as to provide enhanced stability and rigidity to the seat base brackets 134,134, while upper end portions of the seat base brackets 134,134 are provided with inwardly facing angle irons or integrally formed support surfaces 142,142 to which the seat of the reclining chair is adapted to be fixed by suitable fasteners passing through through-holes 144,144 defined within the angle irons or support surfaces 142,142. The upper portion of each one of the seat-base brackets 134,134 is provided with an arcuate slot 146,146, and a first connecting plate 148,148 is pivotally mounted upon an internal side surface of each one of the seat-base brackets 134,134 by a first pin 150 which passes through a hole or aperture 152 defined within each one of the seat-base brackets 134,134 so as to be connected to linkage members of the linkage systems 106,106 as will be discussed more fully hereinafter. A second pin 154,154 mounted upon each one of the first connecting plates 148,148 extends through a respective one of the arcuate slots 146,146 so as to likewise be pivotally connected to the aforenoted linkage members of the linkage systems 106,106 as will be discussed more fully hereinafter. Furthermore, it is also seen that the pair of first connecting plates 148,148 are fixedly connected together by a third transversely oriented cross-tube 156 so as to effectively provide the first connecting plates 148,148 with enhanced stability and rigidity. It is lastly noted that the first linear actuator 108 has its motor end operatively connected to the third transversely oriented cross-tube 156 by a suitable clevis-type mounting bracket 158, while its telescopic rod end is operatively connected to the second, transversely oriented base member 118 by a suitable clevis-type mounting bracket 160, the telescopic rod of the first linear actuator 108 being shown at 161 within FIG. 5.

With reference now being made to FIGS. 1-4 and 6-9, the pair of left and right-side linkage systems 106,106 of the mechanism 100 for the zero-gravity reclining chair will now be described. More particularly, it is seen each one of the left and right-side linkage systems 106,106 comprises a reclining link assembly, each one of which comprises a backrest bracket 162,162 which has a substantially T-shaped configuration and which is adapted to have a backrest portion of the zero-gravity reclining chair mounted thereon. Each one of the backrest brackets 162,162 is adapted to be fixedly connected to a second connecting plate 164,164, which can best be seen in FIGS. 1,3, and 4, at respective fastener locations 166,166 which can best be seen in FIGS. 3 and 4. In turn, the second connecting plates 164,164 are fixedly connected to opposite ends of a fourth, transversely oriented cross-tube 168 so as to enhance the stability and rigidity defined between the second connecting plates 164,164. As can also be best appreciated from FIGS. 2-4, the second linear actuator 110 has its telescopic rod end pivotally connected to a clevis-type mounting bracket 170 fixedly mounted upon the fourth, transversely oriented cross-tube 168, while the motor end of the second linear actuator 110 is pivotally connected to another clevis-type mounting bracket 172 fixedly mounted upon the second transversely oriented cross-tube 140. The telescopic rod of the second linear actuator 110 can best be seen at 173 within FIG. 3.

Figure 1:
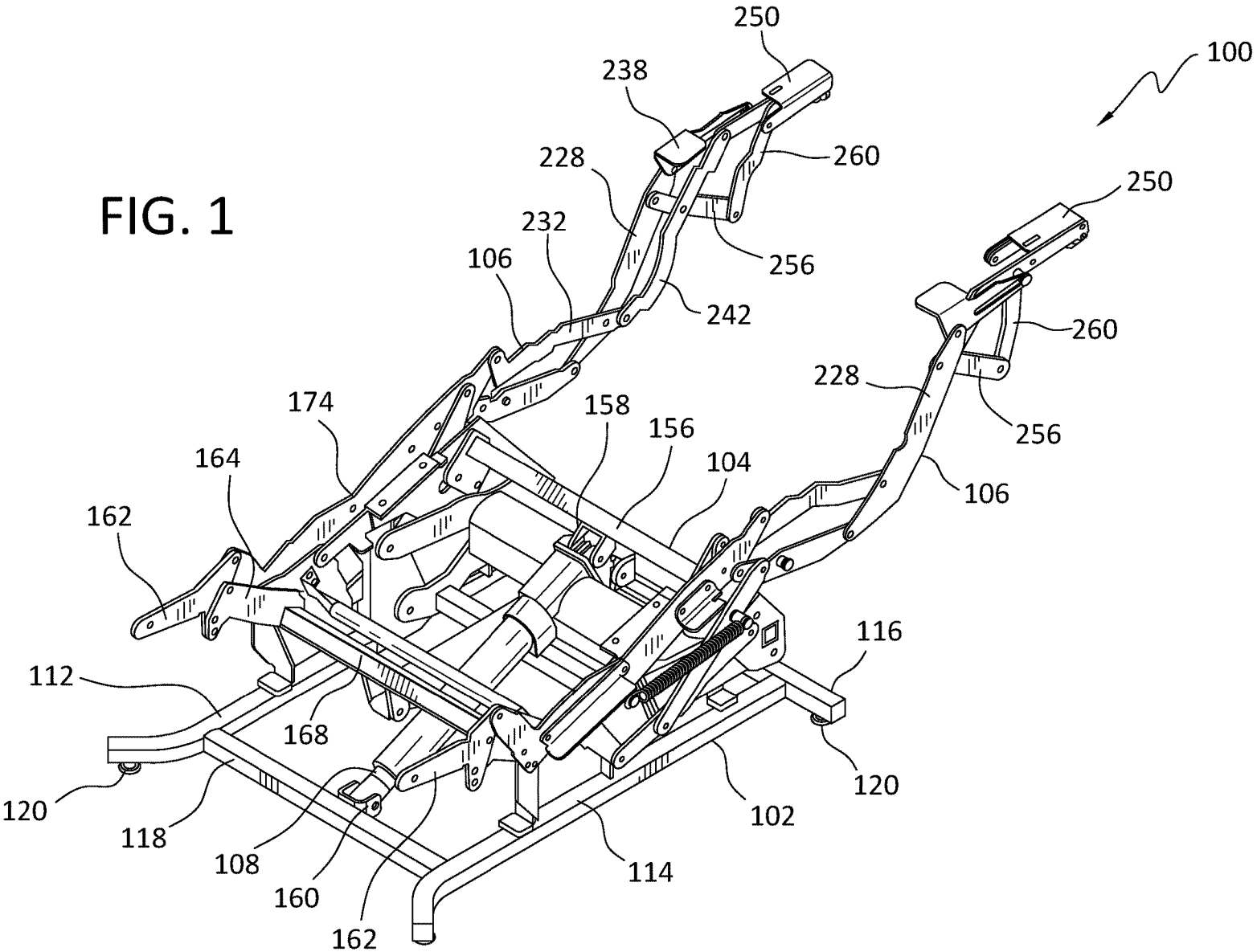
Figure 2:
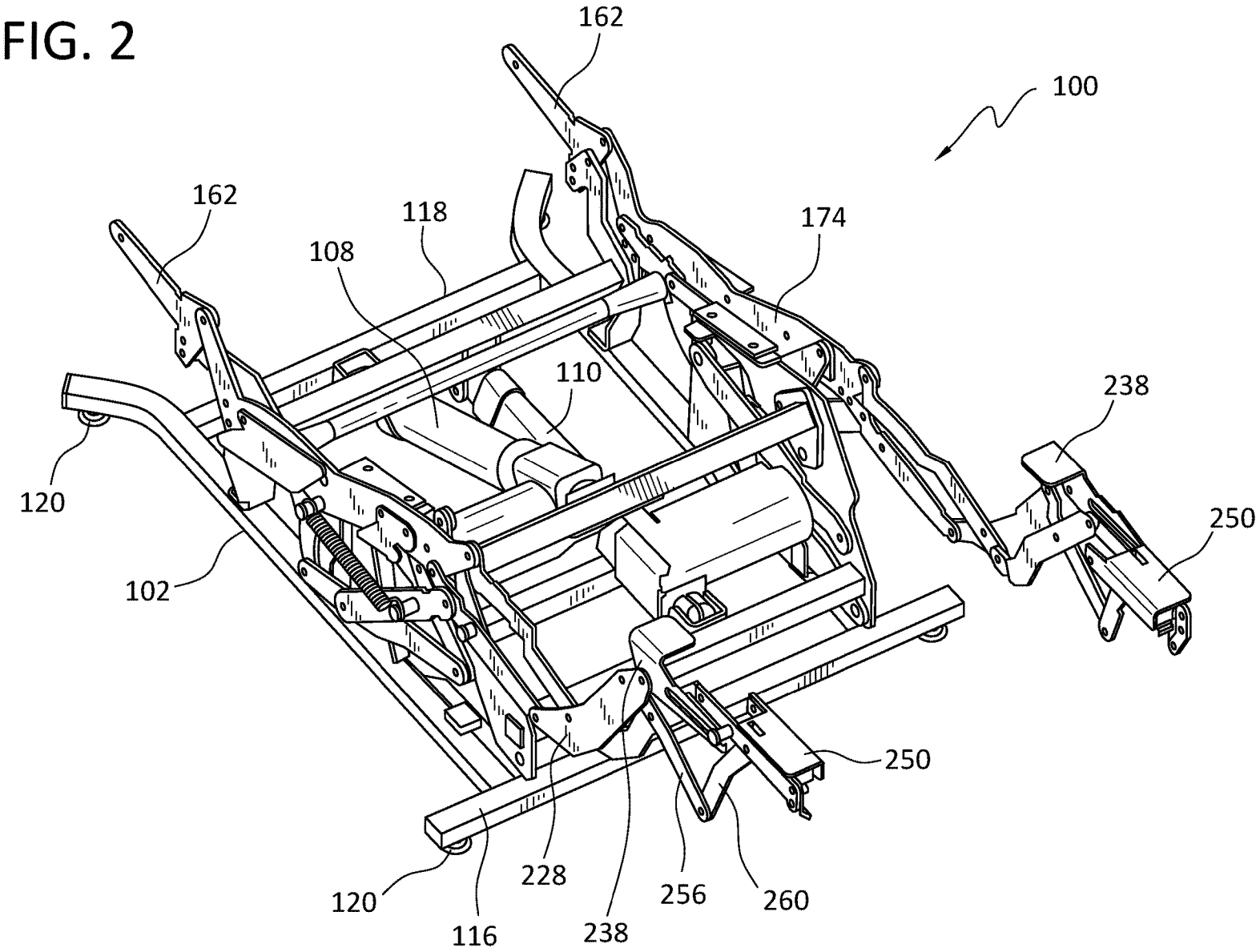
FIG. 2 is a front, right side, perspective view of the zero-gravity reclining chair as illustrated within FIG. 1.
Figure 3:
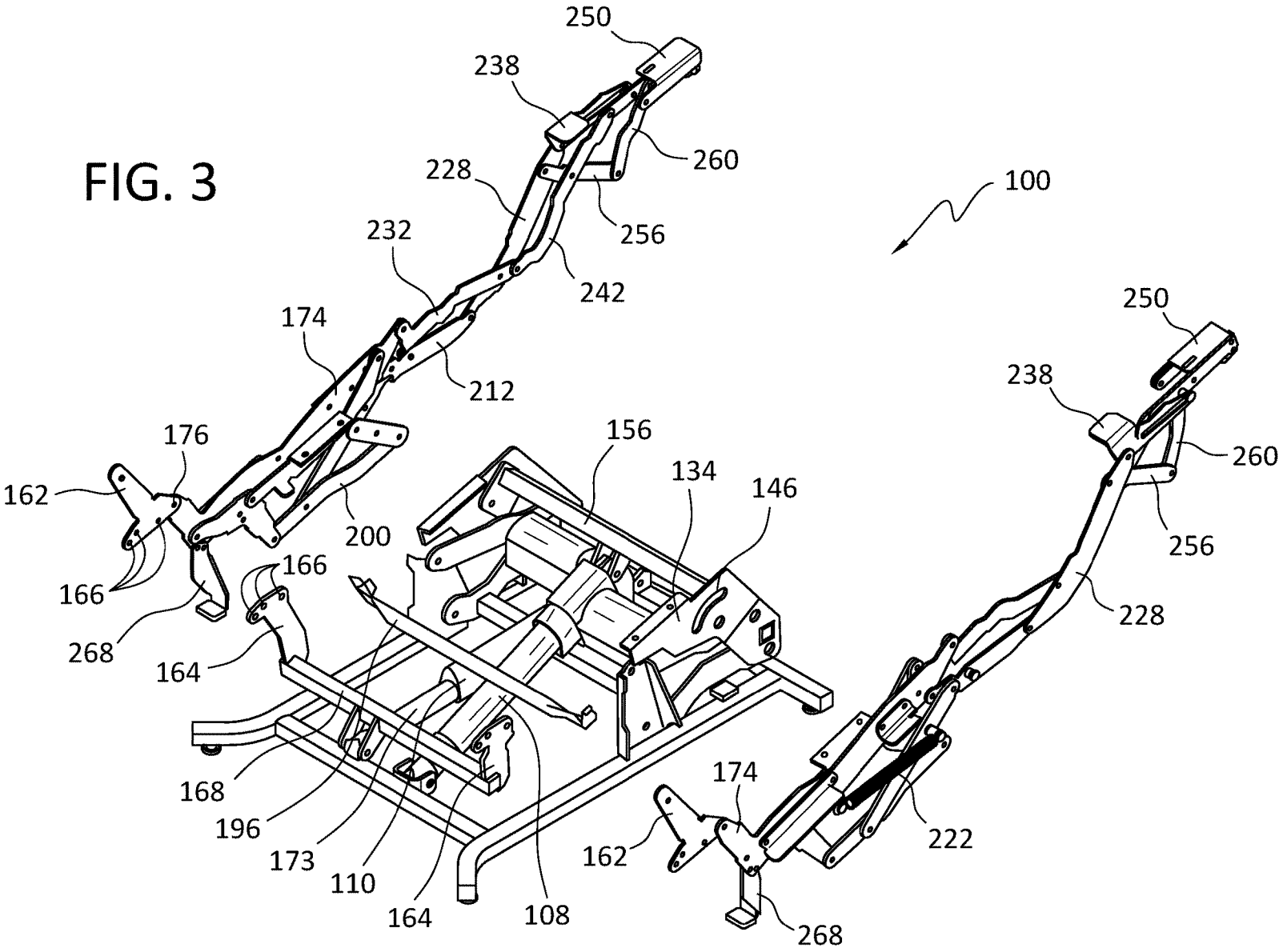
FIG. 3 is an exploded perspective view of the zero-gravity reclining chair as shown in FIG. 1, but shown in the TV position.
Figure 4:
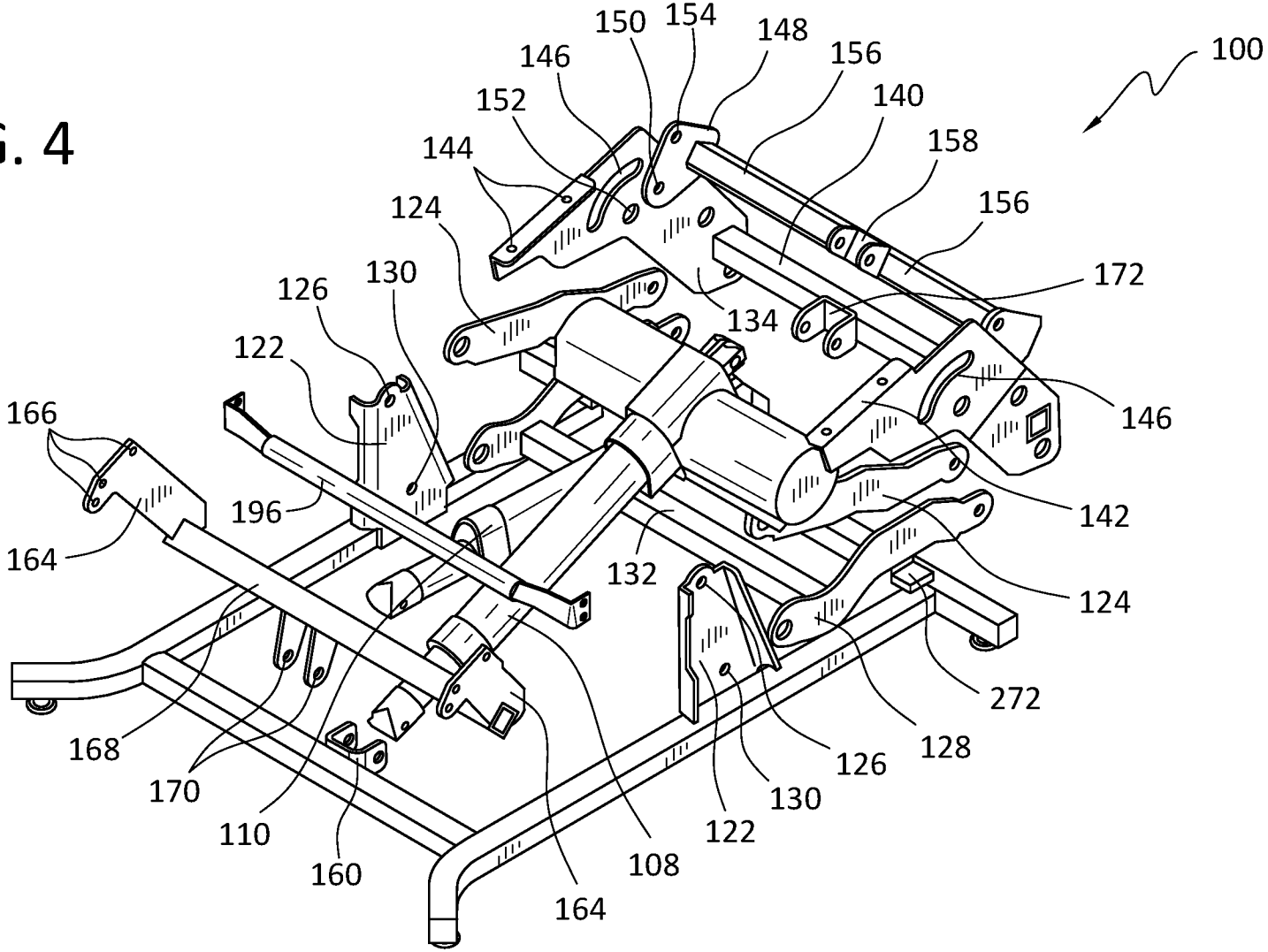
FIG. 4 is an exploded perspective view of most of the chair base and chair framework components as illustrated in FIG. 1.

Continuing further, and as can best be appreciated from FIG. 9, the left and right-side linkage systems 106,106 are seen to comprise first L-shaped main or primary links 174,174 which are pivotally connected to the backrest brackets 162,162 as at pivotal connections 176,176, second, substantially L-shaped links 178,178 which are pivotally connected to the first L-shaped main or primary links 174,174 as at pivotal connections 180,180, third links 182, 182 which are pivotally connected to the first L-shaped main or primary links 174, 174 as at pivotal locations 184,184 located at the opposite ends of the first L-shaped main or primary links 174,174 upon which the second, substantially L-shaped links 178,178 are pivotally mounted, and fourth, elongated links 186,186 which are pivotally connected at rear end portions thereof to the vertex portions of the second, substantially L-shaped links 178,178 by pivotal connections 188,188, while forward end portions of the fourth, elongated links 186,186 are pivotally connected to the third links 182,182 by pivotal connections 190,190. It is further seen that lower edge portions of the fourth, elongated links 186,186 are provided with inwardly oriented tabs or legs 191,191 which are adapted to rest upon upper surface portions of the upstanding chair-framework mounting brackets 122,122 when the reclining chair is disposed at its seated position, while upper edge portions of the fourth, elongated links 186,186 are provided with inwardly oriented mounting surfaces 192,192 that are provided with pairs of holes or apertures 194,194 which are adapted to be aligned with the apertures 144,144 defined within the support surfaces 142, 142 of the seat base brackets 134,134 such that the seat base brackets 134,134 can be fixedly secured to the fourth, elongated links 186,186 of the left and right side linkage systems 106,106. It is lastly noted that a fifth, transversely oriented cross-tube 196, as can best be seen in FIGS. 3 and 4, is adapted to have its opposite ends fixedly secured to oppositely disposed, interior surfaces of the second, substantially L-shaped links 178,178 as at fastener locations 198,198 as seen in FIG. 9.

With reference now being made to FIGS. 6-8, and continuing further with the description of the left and right-side linkage systems 106,106, each one of the left and right-side linkage systems 106,106 further comprises an actuation link assembly which comprises a pair of fifth links 200,200, which can probably best be seen and appreciated from FIG. 8, and it is seen that one end of each one of the fifth links 200,200 is pivotally connected to the end of each one of the second, substantially L-shaped links 178,178, that is disposed opposite the end at which each one of the second, substantially L-shaped links 178,178 is pivotally connected to the first L-shaped main or primary links 174,174 by the pivotal connections 180,180, by pivotal connections that are shown at 202,202. One end of each one of a pair of sixth links 204,204 is pivotally connected to an external side surface portion of its corresponding fifth link 200,200 by a pivotal connection 206,206, while the ends of the fifth links 200,200, that are disposed opposite the ends of the fifth links 200,200 that are pivotally connected to the second, substantially L-shaped links 178,178 by the pivotal connections 202,202, are connected to first ends of seventh links 208,208 by pivotal connections that are shown at 210,210, all as can also be seen in FIG. 6.

It is also to be noted at this junction that the pins 150,150 of the first connecting plates 148,148 are pivotally connected to central portions of the seventh links 208,208 as at pivotal connections 209,209, while the pins 154,154 of the first connecting plates 148,148 are pivotally connected to second ends of the seventh links 208,208 as at pivotal connections 211,211, again, as can best be appreciated from FIG. 6. In a similar manner, the ends of the sixth links 204,204, that are disposed opposite the ends of the sixth links 204,204 that are pivotally connected to the fifth links 200,200 by the pivotal connections 206,206, are connected to first end portions of a pair of first footrest swing links 212,212, which will be described more fully hereinafter, by pivotal connections that are shown at 214,214, all as can best be seen in FIG. 8, while ultimate first end portions of the first footrest swing links 212, 212 are pivotally connected to the first L-shaped main or primary links 174,174 by pivotal connections 216,216. It is also noted that each one of the first footrest swing links 212,212 is provided with a pin 218,218 which extends outwardly from each external surface of each one of the first footrest swing links 212,212 so as to engage a notch 220,220 formed within a lower edge portion of each one of the sixth links 204,204 for a purpose to be described hereinafter. Lastly, each one of the actuation link assemblies comprises a spring 222,222 which has a first end thereof mounted upon a first pin 224,224 which is fixedly attached to a portion of the first L-shaped main or primary links 174,174, while a second end of the spring 222,222 is mounted upon a second pin 226,226 which is fixedly attached to a portion of the sixth link 204,204, all as can best be seen and appreciated from FIG. 8.

Continuing further, and with reference being made to FIGS. 1-3 and 6-8, each one of the left and right-side linkage systems 106,106 further comprises a footrest link assembly wherein it is seen that the second end of each one of the first footrest swing links 212,212, that is disposed opposite the first end at which each one of the first footrest swing links 212,212 is pivotally connected to one of the first L-shaped main or primary links 174,174 by pivotal connections 216, 216, is pivotally connected to a first end of a first footrest extension link 228,228 as at pivotal connections 230,230. In addition, first ends of a pair of second footrest swing links 232,232 are also connected to the first L-shaped main or primary links 174,174 by pivotal connections 234,234, while second end portions of the pair of second footrest swing links 232,232 are pivotally connected to the first footrest extension links 228,228 at pivotal connections 236, 236. Continuing still further, it is also seen that second opposite ends of the first footrest extension links 228,228 are pivotally connected to first or rear footrest mounting brackets 238,238 at pivotal connections 240,240, and in a similar manner, first ends of second footrest extension links 242,242 are pivotally connected to ultimate second end portions of the second footrest swing links 232,232 as at pivotal connections 244,244, as can best be seen in FIG. 6. Second opposite ends of the second footrest extension links 242,242 are pivotally connected to second or forward footrest bracket supporting links 246,246 as at pivotal connections 248,248, as can best be appreciated from FIG. 6, wherein the second or forward footrest bracket supporting links 246,246 are connected to second or forward footrest mounting brackets 250,250. The first or rear footrest brackets 238,238 are provided with slots 252,252, as seen in FIG. 8, within which pins 254,254, mounted upon the second or forward footrest mounting brackets 250,250, are adapted to move. Continuing yet further, first footrest actuation links 256,256 are pivotally connected at first ends thereof to the first footrest extension links 228,228 as at pivotal connections 258,258, as best seen in FIG. 6, and are pivotally connected at second ends thereof to first ends of second footrest actuation links 260,260 as at pivotal connections 262,262, second opposite ends of the second footrest actuation links 260,260 being pivotally connected to the second or forward footrest bracket supporting links 246,246 as at pivotal connections 264,264. It is also seen, as can best be appreciated from FIG. 6, that the first footrest actuation links 256,256 are pivotally connected to the second footrest extension links 242,242 at pivotal connections 266,266 which are located between pivotal connections 258,258 and 262,262. It is lastly to be appreciated that both the first and second footrest mounting brackets 238,238,250,250 are adapted to mount first and second footrests thereon such that the extension of the second footrest mounting brackets 250,250, being movable with respect to the first footrest mounting brackets 238,238, are provided so as to alter the effective overall length of the footrest of the reclining chair so as to accommodate tall people who are disposed within the reclining chair.

Having described substantially all of the structural components of the mechanism 100 for achieving the zero-gravity chair, the operation of the same, whereby the zero-gravity chair will effectively be moved between its seated, standing, TV, and reclined/zero-gravity positions, will now be described. More particularly, as can best be seen in FIG. 10, the new and improved mechanism 100 for the zero-gravity reclining chair is disclosed as being in its seated position, state, or mode. When the mechanism 100 is in this position, state, or mode, which we will also refer to as the START or HOME position, it is to be appreciated that the first linear actuator 108 will be disposed in a partially extended state, that is, at a neutral position intermediate its fully retracted and its fully extended positions. Accordingly, when it is desired to move the reclining chair mechanism from its seated position, as illustrated in FIG. 10, to its standing position, as illustrated in FIG. 11, the first linear actuator 108 will be extended from its partially extended or neutral position toward its fully extended position. As a result of this extension of the telescopic rod 173 of the first linear actuator 108, the third transversely oriented cross-tube 156 will be moved upwardly and forwardly which will, in turn, cause the first connecting plates 148,148 to rotate in the clockwise direction around their pivotal connections 150,150, as can best be appreciated from FIGS. 4 and 5. However, since the pins 154,154 upon the first connecting plates 148,148 are already at their most forward positions within the slots 146,146, then rotation of the first connecting plates 148,148 cannot be accomplished relative to the first connecting plates 148,148, and therefore, the first connecting plates 148,148 cause the oppositely disposed, transversely spaced seat base brackets 134,134 to likewise rotate in the clockwise direction relative to the first and second lift links 124,124,128,128 by the pivotal connections 136,136,138,138, while at the same time, lifting or elevating the first and second lift links 124,124,128,128. At this point in time, it can be readily appreciated from FIG. 11 that the zero-gravity reclining chair has not only been elevated, but the seat portion of the zero-gravity reclining chair, as defined by the oppositely disposed, transversely spaced seat base brackets 134,134, have been tilted or inclined such that the forward end portion of the zero-gravity reclining chair seat will be disposed at a lower elevational level than the rear end portion of the zero-gravity reclining chair seat.

Still further, it will be recalled that the upper edge portions of the fourth, elongated links 186,186 are provided with inwardly oriented mounting surfaces 192,192 that are provided with pairs of holes or apertures 194,194 which are adapted to be aligned with the apertures 144,144 defined within the support surfaces 142,142 of the seat brackets 134,134 such that the seat base brackets 134,134 can be fixedly secured to the fourth, elongated links 186,186 of the left and right side linkage systems 106,106. Accordingly, since the seat base brackets 134,134 are connected to the fourth, elongated links 186186, and the fourth, elongated links 186,186 are connected to the seventh links 208,208, then the fourth, elongated links 186,186 and the seventh links 208,208 will therefore be lifted or elevated whereby the zero-gravity reclining chair will effectively attain the standing position as is schematically illustrated within FIG. 11. At this time, it is also noted that each one of the first L-shaped main or primary links 174,174 has a first support plate 268,268 fixedly mounted thereon at connections 270, 270 which are located at the vertices or corners of the first L-shaped main or primary links 174,174 and which can best be seen in FIG. 8, for example, while second support plates 272, 272 are fixedly mounted to undersurface portions of the second lift links 128,128 as can best be seen in FIGS. 4 and 5. When the mechanism 100 for the zero-gravity reclining chair is disposed at its seated position as illustrated within FIG. 10, the first and second support plates 268,268,272,272 will rest upon the left and right-side base members 112,114, however, when the mechanism 100 is moved to the standing position as illustrated within FIG. 11, the first and second support plates 268,268,272, 272 will no longer rest upon the left and right-side base members 112,114. In a similar manner, it is seen that the inwardly oriented tabs or legs 191,191 of the fourth, elongated links 186,186 are adapted to rest upon the upper surface portions of the upstanding chair framework mounting brackets 122,122 when the reclining chair is disposed at its seated or HOME position as illustrated within FIG. 10, but will be removed therefrom when the reclining chair is moved to the standing position as is illustrated within FIG. 11. It is of course to be appreciated that when the first linear actuator 108 is retracted back to its original intermediate, neutral or HOME position, the mechanism 100 will move back from the standing position, as illustrated within FIG. 11, to the seated or HOME position as illustrated within FIG. 10.

Figure 5:
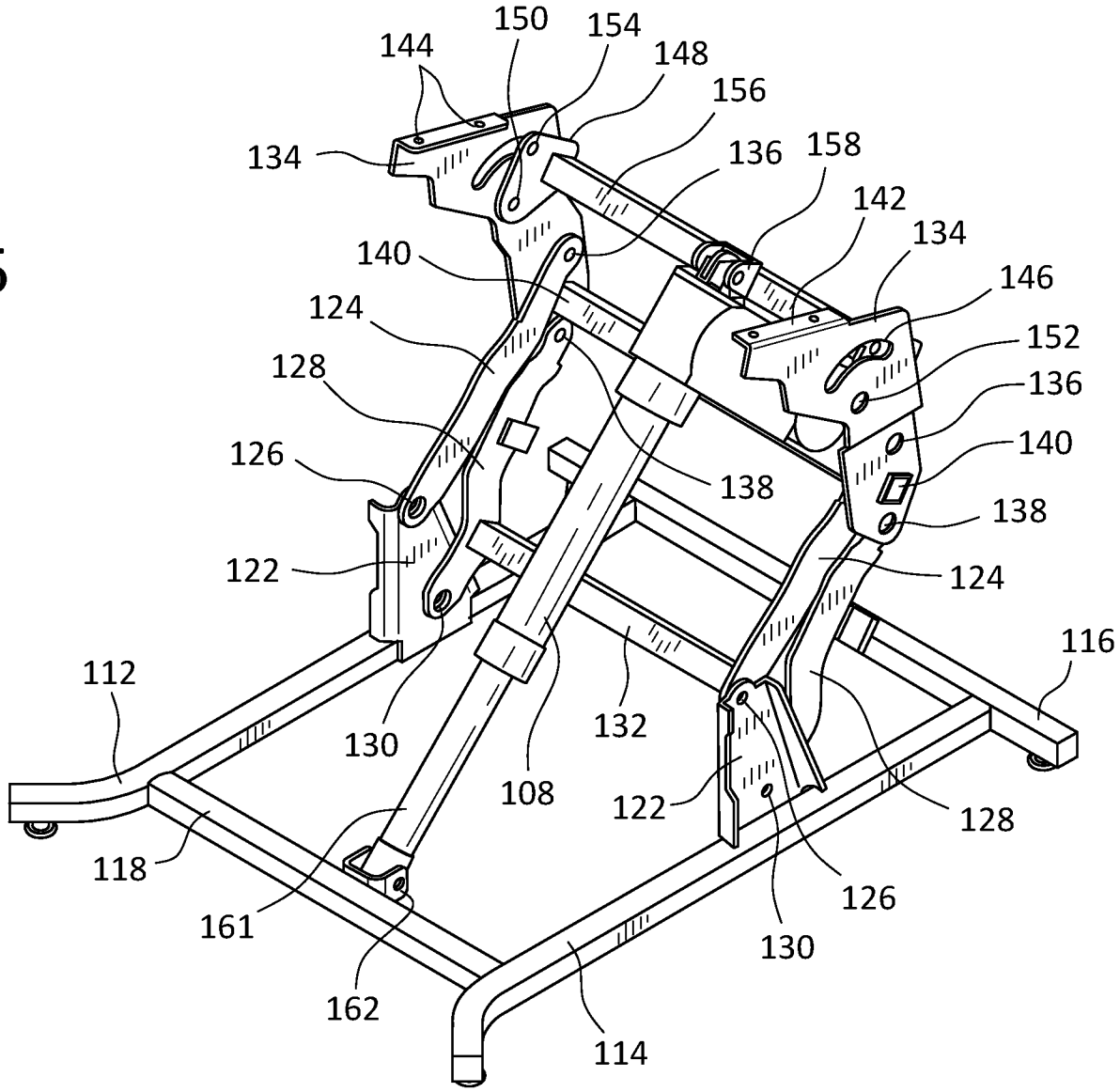
FIG. 5 is a perspective view clearly showing how the first linear actuator is operatively mounted upon and connected to other components of the reclining chair base and framework.

With reference now being made to FIG. 12, when the zero-gravity reclining chair is to be moved from the seated position, as illustrated within FIG. 10, to the TV position as illustrated within FIG. 12, the telescopic rod 161 of the first linear actuator 108 is retracted so as to move the third cross tube 156 rearwardly, which, in turn, causes the first connecting plates 148,148 to rotate in a counterclockwise direction as can best be appreciated from FIGS. 4 and 5. Recalling that the first connecting plates 148,148 are pivotally connected to the seventh links 208,208 of the pair of left and right-side linkage systems 106,106 at pivotal connections 209,209, and that the pins 154,154 of the first connecting plates 148,148 are pivotally connected to the seventh links 208,208 of the pair of left and right-side linkage systems 106,106 at pivotal connections 211,211, then the aforenoted counterclockwise pivotal movement of the first connecting plates 148,148 will cause the seventh links 208,208 to rotate in the counterclockwise direction as can best be appreciated from FIG. 6. At this time, the pins 154,154 will also move within, and to the opposite or rear ends of the slots 146,146. The movement of the seventh links 208,208 also serve to drive the fifth and sixth links 200,200,204,204 forwardly, as can best be appreciated from FIG. 8, so as to, in turn, drive the first footrest swing links 212,212 forwardly and rotationally in a counterclockwise movement around the pivotal connections 216,216. As a result of such movements, the pins 218,218 will have been removed from their notches 220, 220. Still further, the movements of the first footrest swing links 212,212 will cause the first footrest extension links 228,228 and the pair of second footrest swing links 232,232 to be moved forwardly, which, in turn, causes the second footrest extension links 242,242 to move forwardly.

Continuing further, it can then be appreciated that the forward movements of the first footrest extension links 228,228 and the second footrest extension links 242,242 together cause the first or rear footrest mounting brackets 238,238, the first footrest actuation links 256,256, the second footrest actuation links 260,260, and the second or forward footrest mounting brackets 250,250 to move forwardly whereby it will be additionally appreciated that the first and second footrest mounting brackets 238,238,250,250 will have been moved and extended to a substantially horizontal state, as shown in FIGS. 8 and 12, from their vertically downward, stowed state as shown in FIG. 10 when the zero-gravity reclining chair is disposed at its seated or HOME position. It is additionally noted that as the first and second footrest mounting brackets 238,238,250,250 are moved, as has just been described, the pins 254,254 move within slots 252,252 so as to effectively control the movements of the second or forward footrest mounting brackets 250,250 with respect to the first or rear footrest mounting brackets 238,238, and to ensure that the second or forward footrest mounting brackets 250,250 and the first or rear footrest mounting brackets 238,238 are always effectively disposed within the same horizontal plane. As has been previously noted, the purpose of providing the first or rear footrest mounting brackets 238,238 and the second or forward footrest mounting brackets 250,250 is to effectively provide extensible footrest mounting brackets, upon which first and second footrests will be mounted, so as to accommodate tall people who will be disposed within the zero-gravity reclining chair. Lastly, and reverting back to FIGS. 8 and 9, when the fifth links 200,200 are driven forward, the second links 178,178 will be caused to rotate or pivot in the counterclockwise direction as a result of the pivotal connections defined between the fifth links 200,200 and the second links 178,178 by pivotal connections 202,202, and accordingly, since the opposite ends of the second links 178,178 are pivotally connected to the first or primary links 174,174, the rear end portions of the first or primary links 174,174 will move downwardly whereas the forward end portions of the first or primary links 174,174 will move upwardly, thereby imparting a predetermined incline to the seat of the zero-gravity reclining chair.

Lastly, in connection with the various movements of the mechanism 100 of the zero-gravity reclining chair undergoes in order that the zero-gravity reclining chair can in fact achieve the various seated, standing, TV, and zero-gravity reclined positions, when it is desired to move the zero-gravity reclining chair from the TV position illustrated within FIG. 12 to the zero-gravity reclined position illustrated within FIG. 13, the second linear actuator 110 is activated such that the telescopic rod 173 of the second linear actuator 110 is retracted. Since the rod end of the second linear actuator 110 is operatively connected to the fourth, transversely oriented cross-tube 168, retraction of the telescopic rod 173 of the second linear actuator 110 causes the fourth, transversely oriented cross-tube 168 to be moved forwardly, as may best be appreciated from FIGS. 1,3, and 4. Accordingly, since the opposite ends of the fourth, transversely oriented cross-tube 168 are fixedly connected to the oppositely disposed pair of second connecting plates 164, 164, and since the oppositely disposed pair of second connecting plates 164,164 are fixedly secured to the backrest brackets 162,162 as at the fastener locations 166,166, the assembly comprising the fourth, transversely oriented cross-tube 168, the pair of oppositely disposed second connecting plates 164,164, and the pair of oppositely disposed backrest brackets 162,162 will tend to be moved or pulled forwardly resulting in the pivotal movement of the pair of oppositely disposed backrest brackets 162,162 around their pivotal connections 176,176 to the first L-shaped main or primary links 174,174.

In this manner, the pair of oppositely disposed backrest brackets 162,162 are able to be moved from their TV positions as illustrated within FIG. 12 to their reclined positions as illustrated within FIG. 13. It is to be noted that when the pair of oppositely disposed backrest brackets 162,162 are disposed at their reclined positions as illustrated within FIG. 13, the backrest of the zero-gravity reclining chair will be disposed at an elevational level which is equal to, or slightly below, the elevational level at which the first and second rear and forward footrest mounting brackets 238,238,250, 250 are disposed such that the beneficial health effects of the zero-gravity reclining chair can be achieved. It is lastly noted that when the zero-gravity reclining chair is to be returned from the reclined position, as illustrated within FIG. 13, to the seated or HOME position, as illustrated within FIG. 10, the zero-gravity reclining chair mechanism 100 must first attain or pass through the TV position as illustrated within FIG. 12. Yet further, it is to be specifically noted that when the zero-gravity reclining chair is to be returned from either the TV position, as illustrated within FIG. 12, or from the reclined position, as illustrated within FIG. 13, to the seated or HOME position, as illustrated within FIG. 10, the pins 218, 218 mounted upon the first footrest swing links 212,212, will again be disposed within the notches 220,220 defined upon the sixth links 204,204 such that the pins 218,218 effectively serve as limit pins or stops so as to ensure that the various linkage members comprising the pair of left and right-side linkage systems 106,106 regain their proper positions and orientations.

In order to control the first and second linear actuators 108,110, a suitable remote-control device 274 can be utilized, the remote-control device 274 being illustrated within FIG. 14. The remote-control device 274 can be operatively connected to the zero-gravity reclining chair mechanism 100 either by hard-wired connections or by wireless connections. In particular, it is seen that the remote-control device 274 is provided with a first pair of control buttons 276,278 for respectively controlling the extension or retraction of the first linear actuator 108 whereby, as has been previously noted, when the control button 276 is depressed, the first linear actuator 108 will be extended from its intermediate or HOME position, as a result of which the zero-gravity reclining chair mechanism 100 will move the zero-gravity reclining chair, and more particularly the seat of the zero-gravity reclining chair to its elevated position as well as to incline the seat of the chair forwardly and downwardly such that the chair can attain its standing position as illustrated within FIG. 11. Depression of the control button 278 will of course return the zero-gravity reclining chair mechanism 100 and the chair to its original seated or HOME position as illustrated within FIG. 1*n* a similar manner, a second pair of control buttons 280,282 will respectively control the extension or retraction of the first linear actuator 108 whereby, as has been previously noted, when the control button 280 is depressed, the first linear actuator 108 will be retracted from its intermediate or HOME position, as a result of which the seat of the zero-gravity reclining chair will be tilted downwardly and rearwardly while the footrests 238,238,250,250 will be extended such that the zero-gravity reclining chair mechanism 108 and the zero-gravity reclining chair will be moved to its TV position as illustrated within FIG. 12. Depression of the control button 282 will of course return the zero-gravity reclining chair mechanism 100 and the zero-gravity reclining chair to its original seated or HOME position as illustrated within FIG. 10. Still yet further, a third pair of control buttons 284,286 will respectively control the extension or retraction of the second linear actuator 110 whereby, as has been previously noted, when the control button 284 is depressed while the zero-gravity reclining chair mechanism 100 and the zero-gravity reclining chair are disposed at the TV position, the second linear actuator 110 will be retracted, as a result of which the backrest support brackets 162,162 will be pivotally moved rearwardly and downwardly such that the zero-gravity reclining chair mechanism 108 will be moved to its reclined, zero-gravity position as illustrated within FIG. 13. Depression of the control button 286 will of course return the zero-gravity reclining chair mechanism 100 and the zero-gravity reclining chair to its TV position as illustrated within FIG. 12. From this position, the zero-gravity reclining mechanism 100 and the zero-gravity reclining chair can be further moved back or returned to the seated or HOME position of the zero-gravity reclining chair as illustrated within FIGURE by depression of remote-control button 282. Lastly, control button 288 is a HOME button, whereby depression of the same will cause one or both of the linear actuators 108,110 to move the linkage systems 106,106 to their respective positions illustrated within FIG. 10 and corresponding to the seated or HOME position of the zero-gravity reclining chair.

Obviously, many variations and modifications of the present invention are possible in light of the above teachings. For example, the remote-control device, and the control circuitry operatively associated with the remote-control device, may be configured in such a manner such that depression of a particular control button may permit one to move the zero-gravity reclining chair mechanism and the zero-gravity reclining chair from the zero-gravity reclined position, to the TV position, to the seated or HOME position, and then to the standing position. It is also understood that when the depression of any particular remote-control button of the remote-control device is released, the movement or actuation of the first and second linear actuators is terminated such that the various linkage members and structural components of the zero-gravity reclining chair mechanism will be halted at such positions. It is therefore to be understood that within the scope of the appended claims, the present invention may be practiced otherwise than as specifically described herein.

What is claimed is:

1. A mechanism for a zero-gravity reclining chair, comprising:
   - a pair of oppositely disposed seat base brackets for supporting a seat of said zero-gravity chair;
   - a pair of oppositely disposed backrest brackets for supporting a backrest of said zero-gravity chair;
   - a pair of oppositely disposed footrest mounting brackets for supporting a footrest of said zero-gravity chair;
   - a pair of oppositely disposed linkage systems for operatively connecting said pair of oppositely disposed seat base brackets, said pair of oppositely disposed backrest brackets, and said pair of oppositely disposed footrest mounting brackets together; and
   - at least one actuator for moving said pair of oppositely disposed linkage systems in predetermined modes between extended and retracted positions such that said pair of oppositely disposed seat base brackets, said pair of oppositely disposed backrest brackets, and said pair of oppositely disposed footrest mounting brackets can be moved to predetermined positions whereby said zero-gravity reclining chair can attain seated, standing, TV, and reclined-zero gravity positions.

2. The mechanism for a zero-gravity reclining chair as set forth in claim 1, wherein:
   - said at least one actuator comprises a linear actuator.

3. The mechanism for a zero-gravity reclining chair as set forth in claim 2, wherein:
   - said at least one linear actuator comprises a pair of linear actuators.

4. The mechanism for a zero-gravity reclining chair as set forth in claim 3, wherein:
   - each one of said pair of linear actuators comprises an extensible and retractable telescopic rod.

5. The mechanism for a zero-gravity reclining chair as set forth in claim 3, wherein:
   - said pair of linear actuators comprise first and second linear actuators having first and second extensible and retractable telescopic rods movable between said extended and retracted positions.

6. The mechanism for a zero-gravity reclining chair as set forth in claim 5, wherein:
   - said zero-gravity reclining chair is disposed at said seated position when said first extensible and retractable telescopic rod of said first linear actuator is disposed at a position intermediate said extended and retracted positions, and when said second extensible and retractable telescopic rod of said second linear actuator is disposed at said retracted position.

7. The mechanism for a zero-gravity reclining chair as set forth in claim 6, wherein:

when said zero-gravity reclining chair is disposed at said seated position, said pair of oppositely disposed seat base brackets are disposed substantially horizontally, said pair of oppositely disposed backrest brackets are disposed at substantially upright positions, and said pair of oppositely disposed footrest mounting brackets are disposed in substantially vertically oriented downward stowed positions.

8. The mechanism for a zero-gravity reclining chair as set forth in claim 5, wherein:

said zero-gravity reclining chair is disposed at said standing position when said first extensible and retractable telescopic rod of said first linear actuator is disposed at said extended position.

9. The mechanism for a zero-gravity reclining chair as set forth in claim 8, wherein:

when said zero-gravity reclining chair is disposed at said standing position, said pair of oppositely disposed seat base brackets are disposed at elevated positions that are above those positions at which said seat base brackets are disposed when said zero-gravity chair is disposed at said seated position, said seat base brackets are also disposed at inclined positions such that a forward end portion of said seat of said zero-gravity reclining chair is disposed at an elevational level which is beneath an elevational level at which a rear end portion of said seat of said zero-gravity reclining chair is disposed, said pair of oppositely disposed backrest brackets are disposed in substantially upright positions, and said pair of oppositely disposed footrest mounting brackets are disposed in substantially vertically oriented downward stowed positions.

10. The mechanism for a zero-gravity reclining chair as set forth in claim 5, wherein:

said zero-gravity reclining chair is disposed at said TV position when said first extensible and retractable telescopic rod of said first linear actuator is disposed at said retracted position.

11. The mechanism for a zero-gravity reclining chair as set forth in claim 10, wherein:

when said zero-gravity reclining chair is disposed at said TV position, said pair of oppositely disposed backrest brackets are disposed in substantially upright positions, said pair of oppositely disposed seat base brackets are disposed at inclined positions at which a rear end portion of said seat of said zero-gravity reclining chair is disposed at a lower elevation than that of a forward end portion of said seat of said zero-gravity reclining chair, and said pair of oppositely disposed footrest mounting brackets are disposed at substantially horizontally oriented extended and elevated positions.

12. The mechanism for a zero-gravity reclining chair as set forth in claim 5, wherein:

said zero-gravity reclining chair is disposed at said reclined position when said second extensible and retractable telescopic rod of said first linear actuator is disposed at said retracted position.

13. The mechanism for a zero-gravity reclining chair as set forth in claim 12, wherein:

when said zero-gravity reclining chair is disposed at said reclined position, said pair of oppositely disposed backrest brackets are disposed in reclined positions, said pair of oppositely disposed seat base brackets are disposed at inclined positions at which a rear end portion of said seat of said zero-gravity reclining chair is disposed at a lower elevation than that of a forward end portion of said seat of said zero-gravity reclining chair, and said pair of oppositely disposed footrest mounting brackets are disposed at substantially horizontally oriented extended and elevated positions at which said pair of footrest mounting brackets are disposed at an elevation that is the same as or slightly higher than that of said seat base brackets and said backrest brackets such that said mechanism is disposed within a zero-gravity position or state at which the comfortability of the person is enhanced while the burden upon the person's heart, in order to pump blood throughout the person's body, is effectively reduced.

14. The mechanism for a zero-gravity reclining chair as set forth in claim 1, wherein:

each one of said pair of oppositely disposed footrest mounting brackets comprises first and second footrest mounting brackets wherein said second footrest mounting bracket is movable with respect to said first footrest mounting bracket so as to effectively extend the length of each one of said pair of oppositely disposed footrest mounting brackets so as to comfortably accommodate tall people within said zero-gravity reclining chair.

15. The mechanism for a zero-gravity reclining chair as set forth in claim 1, further comprising:

a remote-control device for operatively controlling said at least one linear actuator between said extended and retracted positions.

16. The mechanism for a zero-gravity reclining chair as set forth in claim 3, further comprising:

a remote-control device for operatively controlling said pair of linear actuators between said extended and retracted positions.

17. The mechanism for a zero-gravity reclining chair as set forth in claim 16, wherein:

said remote-control device for operatively controlling said pair of linear actuators between said extended and retracted positions comprises a remote-control device which is selected from the group comprising a hard-wired remote-control device and a wireless remote-control device.

* * * * *